US010753555B2

(12) United States Patent
Deville

(10) Patent No.: US 10,753,555 B2
(45) Date of Patent: Aug. 25, 2020

(54) LIGHT HANGER, LIGHT HANGING SYSTEMS, AND METHODS OF HANGING LIGHTS

(71) Applicant: Derek Dee Deville, Coral Gables, FL (US)

(72) Inventor: Derek Dee Deville, Coral Gables, FL (US)

( * ) Notice: Subject to any disclaimer, the term of this patent is extended or adjusted under 35 U.S.C. 154(b) by 0 days.

(21) Appl. No.: 16/523,723

(22) Filed: Jul. 26, 2019

(65) Prior Publication Data

US 2020/0041078 A1 Feb. 6, 2020

Related U.S. Application Data

(60) Provisional application No. 62/713,184, filed on Aug. 1, 2018.

(51) Int. Cl.

| | |
|---|---|
| ***F21V 21/00*** | (2006.01) |
| ***F21S 4/10*** | (2016.01) |
| ***F21V 23/06*** | (2006.01) |
| *F21W 121/04* | (2006.01) |
| *F21Y 115/10* | (2016.01) |

(52) U.S. Cl.

CPC ..... *F21S 4/10* (2016.01); *F21V 23/06* (2013.01); *F21W 2121/04* (2013.01); *F21Y 2115/10* (2016.08)

(58) Field of Classification Search

CPC ..... F21S 4/10; F21V 23/06; F21W 2121/04; F21Y 2115/10

USPC ..... 362/249.14

See application file for complete search history.

(56) References Cited

U.S. PATENT DOCUMENTS

| | | | | |
|---|---|---|---|---|
| 4,120,377 | A * | 10/1978 | Charles | A63B 27/00 182/135 |
| 6,467,823 | B1 * | 10/2002 | Brekken | F21V 19/04 29/241 |
| 8,721,121 | B1 * | 5/2014 | Briles | F21S 10/06 362/249.14 |
| 9,943,162 | B1 * | 4/2018 | Samelian | A45F 4/02 |
| 2019/0257460 | A1 * | 8/2019 | Hernandez | H02G 3/18 |

FOREIGN PATENT DOCUMENTS

JP 2018161086 A * 10/2018

* cited by examiner

*Primary Examiner* — Ali Alavi

(74) *Attorney, Agent, or Firm* — Gregory L. Mayback; Dickinson Wright PLLC

(57) ABSTRACT

A system for hanging lights includes a multiple-light string comprising a plug, a power cord having a first power cord end electrically connected to the plug, a length of between approximately 5 and 20 meters, and a second power cord end opposite the first power cord end, a cord of lights electrically connected to the second power cord end to receive power and illuminate at least one of the lights when the plug is connected to an electrical mains, the lights strung successively along a length of between approximately 5 and 20 meters, a plug hurler comprising a throwing weight and a hurler cord having a first hurler end connected to the throwing weight and a second hurler end opposite the first hurler end, and a plug-to-hurler connector comprising a connector body connected adjacent the second hurler end and defining a plug capture orifice shaped to removably receive the plug.

20 Claims, 4 Drawing Sheets

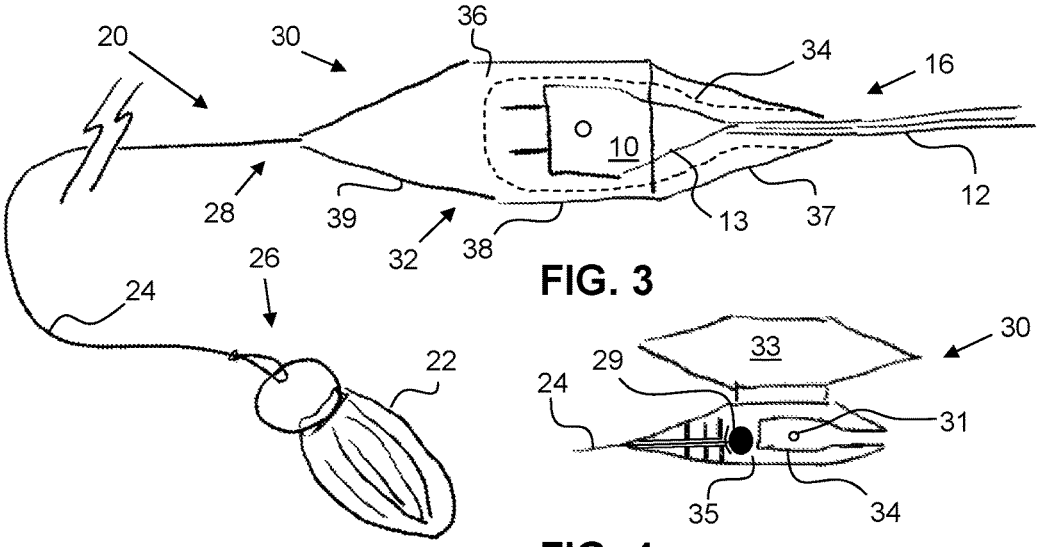
FIG. 3
FIG. 4
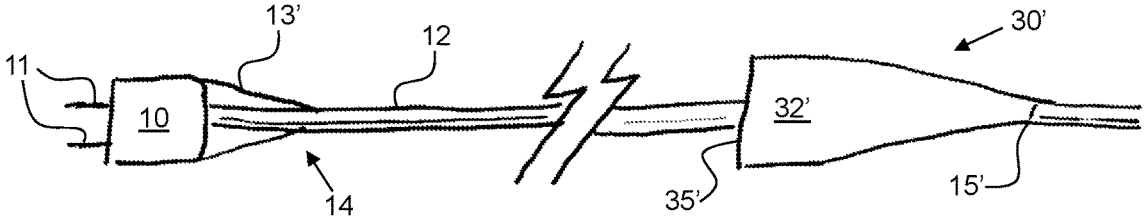
FIG. 5
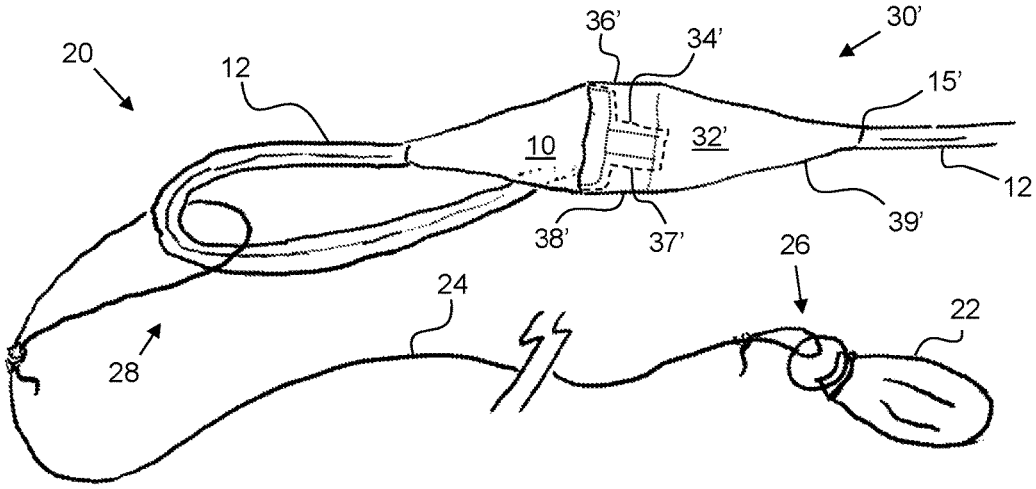
FIG. 6

LIGHT HANGER, LIGHT HANGING SYSTEMS, AND METHODS OF HANGING LIGHTS

CROSS-REFERENCE TO RELATED APPLICATIONS

This application claims the priority, under 35 U.S.C. § 119, of copending U.S. Provisional Patent Application No. 62/713,184 filed Aug. 1, 2018; the prior application is herewith incorporated by reference herein in its entirety.

STATEMENT REGARDING FEDERALLY SPONSORED RESEARCH OR DEVELOPMENT

Not Applicable

FIELD OF THE INVENTION

The present systems, apparatuses, and methods lie in the field of hanging lights. The present disclosure relates to a light hanger, light hanging systems, and methods for hanging lights.

BACKGROUND OF THE INVENTION

It is desirable to hang strings of lights on objects, such as trees. One of the most popular reasons and times for hanging such lights is in the winter during the Christmas season. Many different kinds of light strings are manufactured for location and/or holiday decorations. Previously, most of the light strings used incandescent bulbs; most are now are manufactured with LED lights. In either configuration, the light string had a power supply connector on one end and a power cord extended distally from the power supply connector along a given length. In the U.S., the power supply connector typically took the form of a two-prong (male), 110V electrical mains plug. Typical lengths for the power cord were 5', 6', 10', 12', 20', for example. The lights were electrically connected to the power cord virtually along the entire length. In other words, a characteristic of all such light strings is that the first light started at a very short distance from the power supply connector, for example, one or two feet at most from the power supply connector. There was a reason why the first light started very close to the power supply connector. Most light strings were designed to be connected in series. Therefore, a female electrical socket (e.g., for the male 110V electrical mains plug) was electrically connected at the distal end of the power cord opposite the power supply connector. In this manner, light strings could be extended for long lengths. One example for creating a long length was to wrap around the trunk of a tree and spiral along the trunk's length. If the first light was far away from the plug, and conversely, if the last light was far away from the female electrical socket, then there would be a visual discontinuity in the extended light string, which discontinuity was visually unappealing. Accordingly, prior art light strings were made to have the lights appear visually as a single string with no gaps. To do this, the first light and the last light on the light string were located carefully near or at the plug or the socket, respectively.

To hang these light strings on a vertical structure, for example, from a branch of a tree, the user desired to have the lights start at the branch and extend downwards from that branch. This is because it is not visually appealing to have lights go from the ground up to the branch and then over and down from the branch. Accordingly, to have the desired light structure hanging from the branch, the user needed to connect a non-lighted power extension cord to the mains plug and have the non-lighted power extension cord hang from one side of the branch and the light string hang from the other side of the branch. This desired configuration, however, posed physical and mechanical problems. First, the user needed to know how to place the distal end of the non-lighted power cord (having a female mains socket) at the object over which the cord is hung, e.g., the branch. Next, the user needed to know how to place the light string's mains plug (at its proximal end) at or near the branch so that the first light started at or near the branch and the remaining lights. Third, the user needed to know how get this two-part connection over the branch in the first place. Fourth, the user needed to insure that the mains plug remained attached to the non-lighted power cord while placing the cord-light string over the branch. Fifth, the user needed to know how to prevent the mains plug from being removed from the non-lighted power cord while the two were hanging over the branch.

When a user tried to place the distal end of the non-lighted power extension cord (having a female mains socket) at the branch, the user first threw the male mains plug of the power cord over the branch sufficiently far enough to allow the weight of the plug and cord on the other side of the branch to pull the female side of the power cord up to the branch. However, if the user did not hold onto the female side of the power cord, that cord just went over one side and weight of the cord brought the entire cord over the branch. To prevent the power cord from just being thrown over the branch, the user plugged the male mains plug into the female socket of the power cord and threw the male end of the power cord over the branch. That male end was pulled until the female end of the power cord was located at the branch. However, the weight of the light string on the near side of the branch routinely caused it to slide out of the female end of the power cord, entirely defeating the process of placing the cord-light string on the branch. One way to insure this connection remained was to tape the two connected ends together. However, not only did this destroy the ends of the cord and light string over time due to the adhesive, but also some tape did not work to keep the connection and/or the tape left sticky residue on the cord ends. As such, use of tape was not desirable. Further, branches are not typically smooth, and branches contain many smaller branches and leaves that are not smooth. Accordingly, the power cord and/or its ends typically snagged on the branches and/or leaves. If the male end thrown over the branch snagged, it did not go over the branch at all. If the female end of the power cord snagged, the cord might not be able to be pulled down from the branch after use was ended. Further, the elements, such as wind acting on the connection between the power cord and the light string, which wind moved the branches considerably, routinely caused the connection of the power cord and the light string to separate, even if connected together by tape.

Thus, a need exists to overcome the problems with the prior art systems, designs, and processes as discussed above.

SUMMARY OF THE INVENTION

The systems, apparatuses, and methods described provide a light hanger, light hanging systems, and methods for hanging lights that overcome the hereinafore-mentioned disadvantages of the heretofore-known devices and methods of this general type and that provide such features with a secure and tangle-free way to hang lights from a vertical height above ground.

With the foregoing and other objects in view, there is provided, a system for hanging lights comprising a multiple-light string comprising a plug for an electrical mains, an electrical power cord having a first power cord end electrically connected to the plug, a length of between approximately 5 and 20 meters, and a second power cord end opposite the first power cord end, and a cord of lights electrically connected to the second power cord end to receive power and illuminate at least one of the lights when the plug is connected to the electrical mains, the lights strung successively along a length of between approximately 5 and 20 meters, a plug hurler comprising a throwing weight and a hurler cord having a first hurler end connected to the throwing weight and a second hurler end opposite the first hurler end and configured to removably connect to the plug.

With the objects in view, there is also provided a system for hanging lights comprising a multiple-light string comprising a plug for an electrical mains, an electrical power cord having a first power cord end electrically connected to the plug, an outer surface, a length of between approximately 5 and 20 meters, and a second power cord end opposite the first power cord end, a cord of lights electrically connected to the second power cord end to receive power and illuminate at least one of the lights when the plug is connected to the electrical mains, the lights strung successively along a length of between approximately 5 and 20 meters, a plug hurler comprising a throwing weight and a hurler cord having a first hurler end connected to the throwing weight and a second hurler end opposite the first hurler end, and a plug-to-hurler connector comprising a clamshell connector body removably connected adjacent the second hurler end and having opposing body parts removably connected to one another, the body parts defining a plug capture orifice therebetween and shaped to removably receive the plug therein such that, responsive to closing the clamshell, the plug is fixed within the plug capture orifice, and, responsive to opening the clamshell, the plug is removable from the plug capture orifice, and comprising a central body portion defining an outer surface, a power cord end having an outer anti-snagging surface tapering from the outer surface of the central body portion inwards to the outer surface of the power cord, and a hurler cord end opposite the power cord end and having an outer anti-snagging surface tapering from the outer surface of the central body portion inwards towards and to the second hurler end.

In accordance with a further feature, there is provided a plug-to-hurler connector comprising a connector body connected adjacent the second hurler end and defining a plug capture orifice shaped to removably receive the plug therein.

In accordance with an added feature, the connector body is one of the connector body is removably connected to the second hurler end and fixedly connected adjacent the second hurler end.

In accordance with an additional feature, the connector body is a clamshell having opposing body parts removably connected to one another and defining the plug capture orifice therebetween such that, responsive to closing the clamshell, the plug is fixed within the plug capture orifice, and, responsive to opening the clamshell, the plug is removable from the plug capture orifice.

In accordance with yet another feature, the connector body is connected at the second hurler end and comprises a central body portion defining an outer surface, a power cord end having an outer anti-snagging surface tapering from the outer surface of the central body portion inwards, and a hurler cord end opposite the power cord end and having an outer anti-snagging surface tapering from the outer surface of the central body portion inwards towards and to the second hurler end.

In accordance with yet a further feature, the connector body is removably connected to the second hurler end.

In accordance with yet an added feature, the connector body is fixed at the second hurler end.

In accordance with yet an additional feature, at least the power cord end defines the plug capture orifice removably receiving the plug therein such that, responsive to inserting the plug into the plug capture orifice, the plug is removably fixed within the plug capture orifice, and, responsive to a given removal force, the plug separates from and exits the plug capture orifice.

In accordance with again another feature, the power cord has an outer surface and the outer anti-snagging surface of the power cord end tapers to the outer surface of the power cord when the plug is disposed within the plug capture orifice.

In accordance with again a further feature, the plug has electrical mains connectors and a plug end having an outer anti-snagging surface tapering inwards towards and to the first power cord end and the connector body is connected to the power cord at a point at a distance from the plug and comprises a body portion comprising a distal end defining a plug orifice, an outer surface, and a power cord end opposite the distal end and having an outer anti-snagging surface tapering from the outer surface of the body portion inwards towards and to the power cord adjacent the point.

In accordance with again an added feature, the outer anti-snagging surface of the power cord end, the outer surface of the body portion, and the outer anti-snagging surface of the plug end together form a bi-directional anti-snagging body.

In accordance with again an additional feature, the plug end one of opposite and at an angle to the mains connectors.

In accordance with still another feature, the electrical mains connectors of the plug are configured to removably fix within the plug orifice of the distal end and form a loop with a portion of the power cord between the plug and the connector body.

In accordance with still a further feature, the second hurler end is removably connected to the loop.

In accordance with still an added feature, there is provided a slingshot, the throwing weight shaped to be thrown/shot from the slingshot over a distance.

In accordance with still an additional feature, the electrical mains is one of 110 v, 120 v, and USB.

In accordance with yet an added feature, the electrical power cord is one of 8 gauge, 10 gauge, 12 gauge, 14 gauge, 16 gauge, 18 gauge, and 20 gauge.

In accordance with an added feature, the cord of lights is a string of at least one of successive LED lights, successive incandescent lights, successive fluorescent lights, successive bioluminescent, successive chemiluminescent lights, successive phosphorescent lights, and successive radioluminescent lights.

In accordance with a concomitant feature, the string of lights are Christmas lights.

With the foregoing and other objects in view, there is provided, a method for hanging lights over an object at a vertical height, which comprises the steps of providing a hurler cord, comprising a first hurler end at which a throwing weight is connected and a second hurler end opposite the first hurler end, with a plug-to-hurler connector adjacent the second hurler end, the plug-to-hurler connector comprising a connector body and defining a plug capture orifice, throwing the throwing weight of the plug hurler over the object so that a portion of the hurler cord loops over the object with the throwing weight hanging from a first side of the object and with the second hurler end hanging from a second side of the object, attaching a first end of a multiple-light string adjacent the second hurler end by removably inserting a plug of the multiple-light string into the plug capture orifice, the multiple-light string comprising the plug, an electrical power cord comprising a first power cord end electrically connected to the plug, a length of between approximately 5 and 20 meters, and a second power cord end opposite the first power cord end, and a cord of lights electrically connected to the second power cord end to receive power and illuminate at least one of the lights when the plug is connected to an electrical mains, the lights strung successively along a length of between approximately 5 and 20 meters, and pulling the hurler cord further over the object so that the plug-to-hurler connector passes over the object from the second side to the first side and a given length of the power cord hangs from the first side of the object.

With the objects in view, there is also provided a method for hanging lights over an object at a vertical height, which comprises the steps of providing a hurler cord, comprising a first hurler end at which a throwing weight is connected and a second hurler end opposite the first hurler end, with a plug-to-hurler connector adjacent the second hurler end, the plug-to-hurler connector comprising a connector body and defining a plug capture orifice, removably inserting a plug of a multiple-light string into the plug capture orifice to removably fix the multiple-light string to the plug-to-hurler connector, the multiple-light string comprising the plug, an electrical power cord comprising a first power cord end electrically connected to the plug, a length of between approximately 5 and 20 meters, and a second power cord end opposite the first power cord end, and a cord of lights electrically connected to the second power cord end to receive power and illuminate at least one of the lights when the plug is connected to an electrical mains, the lights strung successively along a length of between approximately 5 and 20 meters, throwing the throwing weight of the plug hurler over the object so that a portion of the hurler cord loops over the object with the throwing weight hanging from a first side of the object and with the second hurler end hanging from a second side of the object, and, with the plug removably inserted in the plug capture orifice, pulling the hurler cord further over the object so that the plug-to-hurler connector passes over the object from the second side to the first side and a given length of the power cord hangs from the first side of the object.

With the objects in view, there is also provided a method for hanging lights over an object at a vertical height, which comprises the steps of providing a hurler cord comprising a first hurler end at which a throwing weight is connected and a second hurler end opposite the first hurler end, providing a multiple-light string comprising a first end, a plug at the first end, an electrical power cord comprising a first power cord end electrically connected to the plug, a length of between approximately 5 and 20 meters, and a second power cord end opposite the first power cord end, a cord of lights electrically connected to the second power cord end to receive power and illuminate at least one of the lights when the plug is connected to an electrical mains, the lights strung successively along a length of between approximately 5 and 20 meters, and a plug-to-hurler connector adjacent the first power cord end, the plug-to-hurler connector comprising a connector body fixed at a distance from the first power cord end and defining a plug orifice, forming a loop with the power cord by removably inserting the plug into the plug orifice, removably attaching the second hurler end to the loop, throwing the throwing weight of the plug hurler over the object so that a portion of the hurler cord loops over the object with the throwing weight hanging from a first side of the object and with the second hurler end hanging from a second side of the object, and pulling the hurler cord further over the object so that the plug-to-hurler connector passes over the object from the second side to the first side and a given length of the power cord hangs from the first side of the object.

In accordance with another mode, the plug-to-hurler connector is removably fixed adjacent the second hurler end.

In accordance with a further mode, the plug-to-hurler connector is fixed to the second hurler end.

In accordance with an added mode, the plug is a plug for an electrical mains configured to removably secure in the plug capture orifice.

In accordance with an additional mode, the connector body of the plug-to-hurler connector is fixed to the power cord at a distance from the plug and the plug is removably fixed to the plug capture orifice to form a loop with the power cord and, which further comprises removably attaching the second hurler end to the loop.

In accordance with yet another mode, the power cord is pulled on the first side of the object so that a given length of the cord of lights hangs from the second side of the object above ground.

In accordance with yet a further mode, the plug is attached to the connector before throwing the weight over the object.

In accordance with yet an added mode, the connector and the power cord together form a bi-directional anti-snagging body.

In accordance with yet an additional mode, the connector body is provided with a central body portion defining an outer surface, a power cord end having an outer anti-snagging surface tapering from the outer surface of the central body portion inwards, and a hurler cord end opposite the power cord end and having an outer anti-snagging surface tapering from the outer surface of the central body portion inwards towards and to the second hurler end, the outer anti-snagging surface of the power cord end, the outer surface of the central body portion, and the outer anti-snagging surface of the hurler cord end together form a bi-directional anti-snagging body.

In accordance with again another mode, the plug is attached into the plug orifice before throwing the weight over the object.

In accordance with again a further mode, the plug is a plug for an electrical mains configured to removably secure in the plug orifice.

In accordance with a concomitant mode, the plug is provided with an outer anti-snagging surface tapering inwards towards and to the first power cord end and the connector body is provided with an outer surface and a power cord end having an outer anti-snagging surface tapering from the outer surface inwards towards and to the power cord, the outer anti-snagging surface of the power cord end, the outer surface of the connector body, and the outer anti-snagging surface of the plug end together form a bi-directional anti-snagging body.

With the light hanger, the light hanging systems, and the methods described herein, the user can easily place the non-lighted portion on one side of the vertical structure (e.g., the branch) and the lighted portion on the other side of the vertical structure. The light hanger, the light hanging systems, and the methods described herein also allow the user to easily send the male plug over the vertical structure. There is no longer a problem with placing the first light at or adjacent the vertical structure because the user can move one end or another of the light hanger to place the transition point at the vertical structure. When this occurs, the first light of the light hanger is at any desired position with respect to the vertical structure (e.g., at or near the branch) and the remaining lights hang down from the vertical structure. There is no longer an issue with how to place a two-part connection over the branch because, after the pull cord is used to place the light string on the vertical structure, the only item hanging on the vertical structure is a single, integral cord—one absent of an intermediate connection that can come apart. Thus, with the light hanger, the light hanging systems, and the methods described herein, there no longer is two-part plug-socket connector at the vertical structure. Because this two-part plug-socket connector no longer appears at the vertical structure, there is no need for preventing a mains plug located at the vertical structure from being removed from the non-lighted power cord while the two are hanging over the branch.

Although the systems, apparatuses, and methods are illustrated and described herein as embodied in a light hanger, light hanging systems, and methods for hanging lights, it is, nevertheless, not intended to be limited to the details shown because various modifications and structural changes may be made therein without departing from the spirit of the invention and within the scope and range of equivalents of the claims. Additionally, well-known elements of exemplary embodiments will not be described in detail or will be omitted so as not to obscure the relevant details of the systems, apparatuses, and methods.

Additional advantages and other features characteristic of the systems, apparatuses, and methods will be set forth in the detailed description that follows and may be apparent from the detailed description or may be learned by practice of exemplary embodiments. Still other advantages of the systems, apparatuses, and methods may be realized by any of the instrumentalities, methods, or combinations particularly pointed out in the claims.

Other features that are considered as characteristic for the systems, apparatuses, and methods are set forth in the appended claims. As required, detailed embodiments of the systems, apparatuses, and methods are disclosed herein; however, it is to be understood that the disclosed embodiments are merely exemplary of the systems, apparatuses, and methods, which can be embodied in various forms. Therefore, specific structural and functional details disclosed herein are not to be interpreted as limiting, but merely as a basis for the claims and as a representative basis for teaching one of ordinary skill in the art to variously employ the systems, apparatuses, and methods in virtually any appropriately detailed structure. Further, the terms and phrases used herein are not intended to be limiting; but rather, to provide an understandable description of the systems, apparatuses, and methods. While the specification concludes with claims defining the systems, apparatuses, and methods of the invention that are regarded as novel, it is believed that the systems, apparatuses, and methods will be better understood from a consideration of the following description in conjunction with the drawing figures, in which like reference numerals are carried forward.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the systems, apparatuses, and methods. Advantages of embodiments of the systems, apparatuses, and methods will be apparent from the following detailed description of the exemplary embodiments thereof, which description should be considered in conjunction with the accompanying drawings in which:

FIG. 3 is a fragmentary, side elevational and partially hidden view of a plug end of the light hanger of FIG. 1 connected to an exemplary embodiment of a plug-to-hurler connector that is fixed to a hurler cord;

FIG. 4 is a fragmentary, side elevational view of an exemplary embodiment of a plug-to-hurler connector that is removably connected to a hurler cord;

FIG. 5 is a fragmentary, side elevational view of an exemplary embodiment of a plug-to-hurler connector that is fixed to a power cord;

FIG. 6 is a fragmentary, perspective view of the plug-to-hurler connector of FIG. 5 looped to connect to a hurler cord and removably closed to form an anti-snagging connector.

DETAILED DESCRIPTION OF THE EMBODIMENTS

Figure 1:
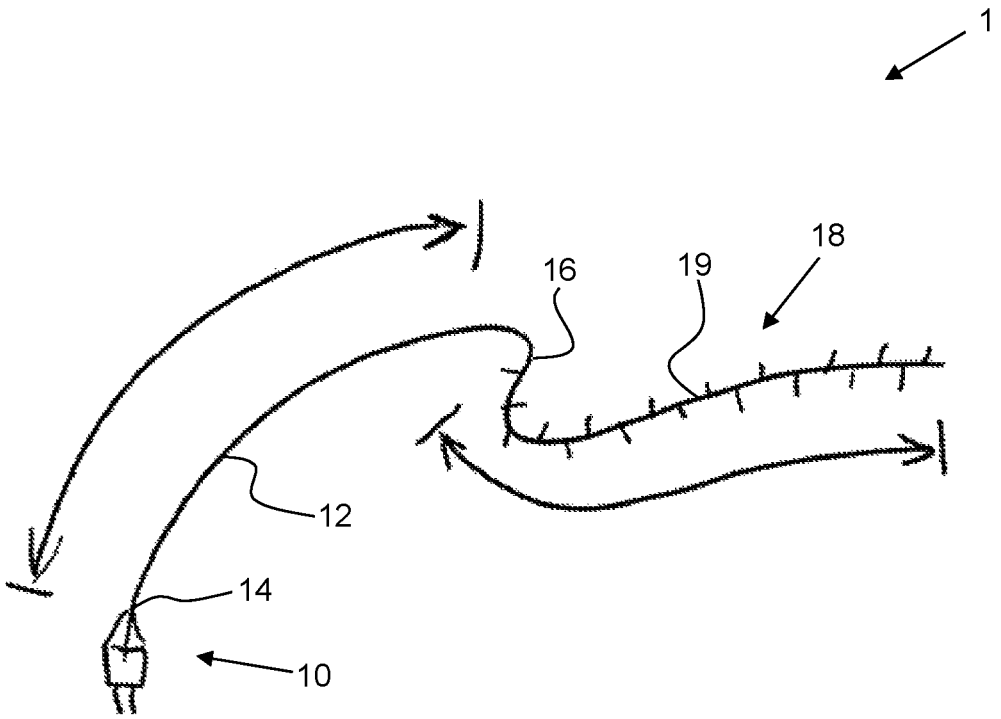
FIG. 1 is a diagrammatic representation of an exemplary embodiment of a light hanger.

As required, detailed embodiments of the systems, apparatuses, and methods are disclosed herein; however, it is to be understood that the disclosed embodiments are merely exemplary of the systems, apparatuses, and methods, which can be embodied in various forms. Therefore, specific structural and functional details disclosed herein are not to be interpreted as limiting, but merely as a basis for the claims and as a representative basis for teaching one skilled in the art to variously employ the systems, apparatuses, and methods in virtually any appropriately detailed structure. Further, the terms and phrases used herein are not intended to be limiting; but rather, to provide an understandable description of the systems, apparatuses, and methods. While the specification concludes with claims defining the features of the systems, apparatuses, and methods that are regarded as novel, it is believed that the systems, apparatuses, and methods will be better understood from a consideration of the following description in conjunction with the drawing figures, in which like reference numerals are carried forward.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Alternate embodiments may be devised without departing from the spirit or the scope of the invention. Additionally, well-known elements of exemplary embodiments of the systems, apparatuses, and methods will not be described in detail or will be omitted so as not to obscure the relevant details of the systems, apparatuses, and methods.

Before the systems, apparatuses, and methods are disclosed and described, it is to be understood that the terminology used herein is for the purpose of describing particular embodiments only and is not intended to be limiting. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including" and/or "having," as used herein, are defined as comprising (i.e., open language). The terms "a" or "an", as used herein, are defined as one or more than one. The term "plurality," as used herein, is defined as two or more than two. The term "another," as used herein, is defined as at least a second or more. The description may use the terms "embodiment" or "embodiments," which may each refer to one or more of the same or different embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact (e.g., directly coupled). However, "coupled" may also mean that two or more elements are not in direct contact with each other, but yet still cooperate or interact with each other (e.g., indirectly coupled).

For the purposes of the description, a phrase in the form "A/B" or in the form "A and/or B" or in the form "at least one of A and B" means (A), (B), or (A and B), where A and B are variables indicating a particular object or attribute. When used, this phrase is intended to and is hereby defined as a choice of A or B or both A and B, which is similar to the phrase "and/or". Where more than two variables are present in such a phrase, this phrase is hereby defined as including only one of the variables, any one of the variables, any combination of any of the variables, and all of the variables, for example, a phrase in the form "at least one of A, B, and C" means (A), (B), (C), (A and B), (A and C), (B and C), or (A, B and C).

Relational terms such as first and second, top and bottom, and the like may be used solely to distinguish one entity or action from another entity or action without necessarily requiring or implying any actual such relationship or order between such entities or actions. The description may use perspective-based descriptions such as up/down, back/front, top/bottom, and proximal/distal. Such descriptions are merely used to facilitate the discussion and are not intended to restrict the application of disclosed embodiments. Various operations may be described as multiple discrete operations in turn, in a manner that may be helpful in understanding embodiments; however, the order of description should not be construed to imply that these operations are order dependent.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. As used herein, the terms "substantial" and "substantially" means, when comparing various parts to one another, that the parts being compared are equal to or are so close enough in dimension that one skill in the art would consider the same. Substantial and substantially, as used herein, are not limited to a single dimension and specifically include a range of values for those parts being compared. The range of values, both above and below (e.g., "+/−" or greater/lesser or larger/smaller), includes a variance that one skilled in the art would know to be a reasonable tolerance for the parts mentioned.

Herein various embodiments of the systems, apparatuses, and methods are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Figure 2:
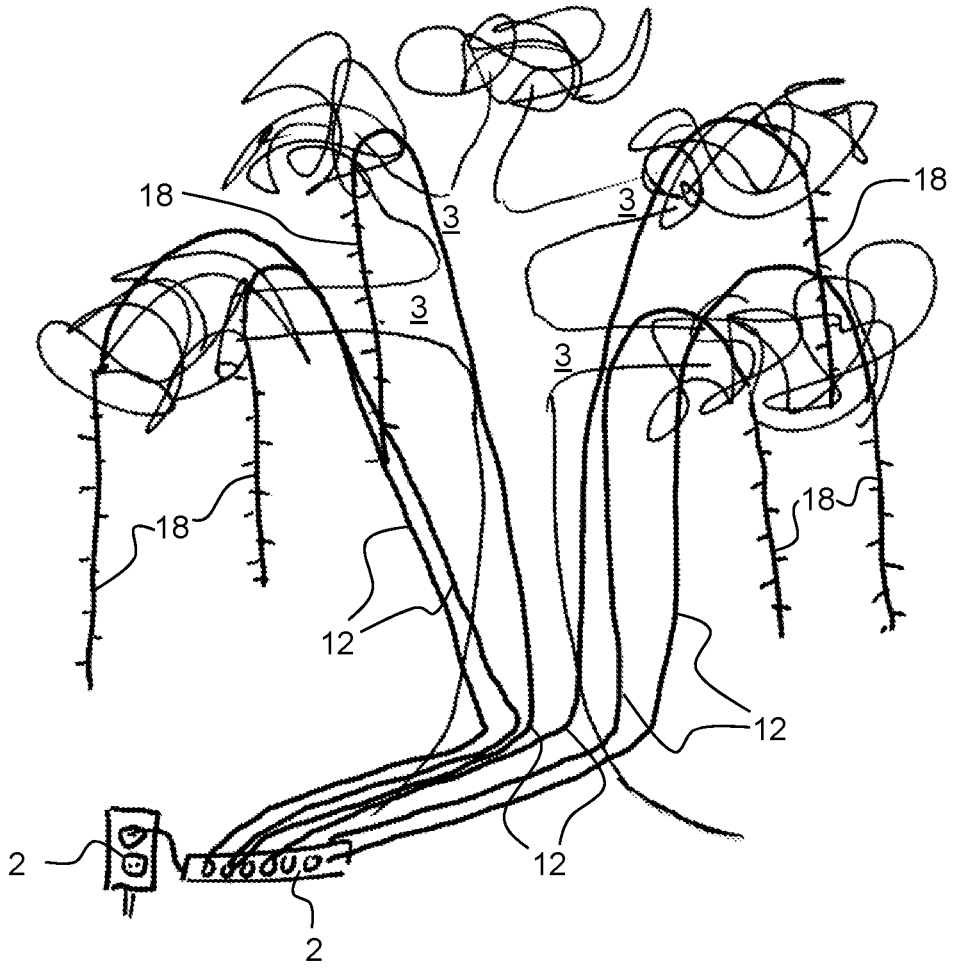
FIG. 2 is a diagrammatic perspective view of a plurality of the light hangers of FIG. 1 draped over various vertical structures as tree branches with plugs connected to an electrical mains.

Described now are exemplary embodiments. Referring now to the figures of the drawings in detail and first, particularly to FIG. 1, there is shown a first exemplary embodiment of a light hanger that is part of a light hanging system. The light hanger comprises a multiple-light string or cord 1 having at a proximal end a plug 10 for an electrical mains 2. In an exemplary embodiment, the plug 10 is a two-prong (male), 110V electrical mains plug. Alternatively, the plug 10 can be a 120V electrical mains, a USB power connector, or any other equivalent power connector. The multiple-light string 1 comprises an electrical power cord 12 and a cord of lights 18. The power cord 12 has a first power cord end 14 electrically connected to the plug 10 and a second power cord end 16 opposite the first power cord end 14. The length of the power cord 12 is between approximately 2 meters and approximately 20 meters in an exemplary embodiment. In an exemplary embodiment, the power cord 12 is 8 gauge, but the power cord can be any gauge, e.g., 10, 12, 14, 16, 18, or 20 gauge. Most vertical structures over which the multiple-light string 1 is to be hung are envisioned to between 3 and 10 meters above the ground (even though structures higher than 10 meters are possible as well). Accordingly, the length is selected to be sufficient to run from the electrical mains 2 (see, e.g., FIG. 2) to the vertical structure 3, examples of which are shown in FIG. 2 as branches of a tree. Thus, a particular length of the power cord 12 is between approximately 5 meters and approximately 15 meters. In particular, the length of the power cord 12 is between approximately 10 meters and approximately 15 meters. As described in further detail below, a plurality of multiple-light strings 1 are part of a light hanger set or light hanger system. The length of each power cord 12 can be the same for each of the plurality of multiple-light strings 1. In an alternative embodiment, the length is different for some of the multiple-light strings 1. The cord of lights 18 is electrically connected at a second power cord end 16 (which, in the exemplary embodiment, is not a terminal end of the power cord 12 supplying power to the cord of lights 18 but, instead, is a place on the multiple-light string 1 at which a first light of the cord of lights 18 is located). The power cord 12 supplies power to the cord of lights 18 and illuminates at least one of the lights when the plug 10 is connected electrically to the electrical mains 2. The cord of lights 18 has individual lights strung along a length of light cord 19 that is between approximately 5 meters long and approximately 15 meters long. The cord of lights 18 are individual lights placed successively on the light cord 19, or they are placed in multiple bunches of 2, 3, or more lights. The lights can be Christmas lights. As used herein, the lights can be any light-illuminating device including, but not limited to, incandescent, fluorescent, bioluminescent, chemiluminescent, phosphorescent, radioluminescent, and light-emitting diode (LED) lights. In an exemplary embodiment, the length of the cord of lights 18 is between approximately 2 meters and approximately 20 meters. More specifically, the length is between approximately 5 meters and approximately 15 meters. In particular, the light is between approximately 5 meters and approximately 10 meters.

Each of the multiple-light strings 1 is configured to have the power cord 12 run from the electrical mains 2 up to the vertical structure 3 and to have the cord of lights 18 hang down from the vertical structure 3 (on the other side thereof) to a given distance as shown in FIG. 2. In the examples shown in FIG. 2, the lengths of the power cords 12 are the same and the lengths of the cord of lights are also the same, but these lengths can be set to different lengths for particular applications. For example, if some branches are 10 meters high and some are 5 meters high and some are 3 meters high, then if the lengths of the cord of lights 18 are desired to end at the same height above ground, e.g., at 1 meter above ground, then some sets of lights 18 can be 9 meters long, some can be 4 meters long, and some can be 2 meters long, respectively.

As is apparent, with vertical structures 3 being at 3, 5, or 10 meters high, a person cannot simply reach up and pass the plug 10 over the branch, for example. That plug 10 needs to be passed over the vertical structure 3. Accordingly, the light hanger system comprises a plug hurler 20. One exemplary embodiment of the plug hurler 20 is shown in FIGS. 3 and 4 and another exemplary embodiment of the plug hurler 20 is shown in FIGS. 5 and 6.

In the exemplary embodiment shown in FIGS. 3 and 4, the plug hurler 20 comprises a throwing weight 22, a hurler cord 24, and a plug-to-hurler connector 30. A first hurler end 26 of the hurler cord 24 is connected to the throwing weight 22. The plug-to-hurler connector 30 is connected to a second hurler end 28 opposite the first hurler end 26. In this embodiment, the connection of the plug-to-hurler connector 30 to the second hurler end 28 can be permanent or it can be removable. The permanent connection can take any form. For example, the plug-to-hurler connector 30 can have a proximal orifice in which the second hurler end 28 is fixed, for example, with an adhesive or epoxy.

FIG. 4 illustrates an exemplary embodiment where the connection of the plug-to-hurler connector 30 to the second hurler end 28 is removable. In this configuration, the second hurler end 28 has an anchor 29. The anchor 29 can take any form and even can be a knot tied at the end of the hurler cord 24 or it can be a widening formed at the end, such as a melting of synthetic materials into a knob or a heat-set end cap, or an end finish such as soft eye splice or a hard eye splice that contains a shaped insert, such as a teardrop. This anchor 29 is shaped/sized to insert into a portion of the plug-to-hurler connector 30 and remain there until removed by a user. One exemplary embodiment of the anchor-to-connector attachment has one of the halves of the plug-to-hurler connector 30 define a pocket and a cord channel. The cord channel allows the distal end of the hurler cord 24 to lie therein as the anchor 29 is placed within the pocket at the interior end of the cord channel. The pocket can have any shape. For example, the pocket can be a concave disc with the cord channel traveling from the proximal end of the plug-to-hurler connector 30 up to and through the disc. The anchor 29 can be convexly shaped to fit matingly within the disc such that any force by the hurler cord 24 on the anchor 29 is counteracted by the disc with the disc shape keeping the convex shaped anchor 29 from moving out therefrom.

In the removable embodiment, the plug-to-hurler connector 30 comprises a connector body 32 in the form of a clamshell having opposing body parts 33, 35 removably connectable to one another. The removable connection of the shell halves 33, 35 can be, for example, a pin on one shell half 33 having a split head that inserts into a press fit orifice on the other shell half 35. An exterior strip of a hook-and-loop fastener can be long enough to encircle the clamshell and keep the shell halves 33, 35 together from the outside as another exemplary configuration. One or both of the shell halves 33, 35 define a plug capture orifice 34 therebetween. Either one shell half 33 or the other shell half 35 can define the entirety of the plug capture orifice 34 or both can define a portion of the plug capture orifice 34, wherein for an entirely centered orifice 34, both halves 33, 35 define one-half of the plug capture orifice 34. The plug capture orifice 34 is shaped so that, responsive to closing of the clamshell, the plug 10 becomes fixed within the plug capture orifice 34. For example, the plug capture orifice 34 can have a form-locking shape substantially the same as the outline of the plug 10 when disposed therein. A form-locking or form-fitting connection is one that connects two elements together due to the shape of the elements themselves, as opposed to a force-locking connection, which locks the elements together by force external to the elements. This form-locking fixation is defined to remain fixed when a maximum defined force is placed by the user on either or both of the hurler cord 24 and/or the multiple-light string 1 (e.g., when pulling one during use). This maximum force is defined by the amount of force necessary to pull one or both of the parts over the vertical structure 3 as well as the force that is needed to pull one or both of the parts away from the vertical structure 3 if some part becomes stuck or snagged at the vertical structure 3. Responsive to opening the clamshell by the user (and, desirably, not by typical forces or actions that occur when moving one or both of the hurler cord 24 and/or the multiple-light string 1 over the vertical structure 3), the plug 10 is easily removable from the plug capture orifice 34 by a user. If desired, the plug 10 can have features that assist in holding the plug 10 within the plug capture orifice 34. Such features can be force-locking features. One exemplary embodiment of a force-locking feature can provide the plug 10 with a central cylindrical bore (see, e.g., FIG. 3) partly or completely through the body of the plug 10. Correspondingly, one of the shell halves 33, 35 provides a boss 31 within the plug capture orifice 34 having a cylindrical shape substantially the same as the bore and orthogonal to the longitudinal directions of the hurler cord 24 or the power cord 12. In such a configuration, when the bore of the plug 10 is slid over the boss, the plug 10 cannot be pulled out of the plug capture orifice 34 (in the longitudinal directions of the hurler cord 24 or the power cord 12) without shearing off the boss. The boss 31 is illustrated diagrammatically in FIG. 4 with the small circle within the plug capture orifice 34 and the orifice in the plug 10 is illustrated diagrammatically in FIG. 3.

Another example for securing the plug 10 into the plug-to-hurler connector 30 takes advantage of the lateral holes present in standard electrical mains connectors 11 (e.g., male flat Edison connectors). The connector body 32 is formed with a female Edison plug having one or more movable cross-rods that, when actuated, pass through and mechanically lock within the holes in the blades of the electrical mains connectors 11. In such a configuration, the connector body 32 does not need to be made larger than the outer diameter of the plug 10. Instead, the outer diameter of the connector body 32 can be the same shape and size as the body of the plug 10. Then, when the electrical mains connectors 11 are inserted into the female Edison plug, the movable cross-rods pass though the holes and lock the electrical mains connectors 11 to and within the connector body 32. This allows the connector body 32 to have a lower profile and provides a logical way to connect the two parts by, for example, pressing in a button that extends the cross-rod(s) and then pressing it again to release the cross-rod(s). In such a configuration, the male plug 10 forms the right half of the connector parts 30, 32 and can be a simple frusto-conical shape that tapers down to the power cord 12. This frusto-conical shape can have the push button that disengages the mechanical inserts that pass into and through the male flat Edison connectors.

As indicated, the plug hurler 20 is used to pass the plug 10 over a vertical structure 3 without snagging. Accordingly, the connector body 32 defines anti-snagging features at the second hurler end 28 and at an opposing end facing the electrical power cord 12. In the exemplary embodiment of FIG. 3, a central body portion 36 of the connector body 32 defines an outer surface 38 that is adjacent a power cord end 37 and has an outer anti-snagging surface tapering from the outer surface 38 of the central body portion 36 inwards to and adjacent the power cord 12. A hurler cord end 39 opposite the power cord end 37 has an outer anti-snagging surface tapering from the outer surface 38 of the central body portion 36 inwards towards and to the second hurler end 28. As the second hurler end 28 is fixed to the plug-to-hurler connector 30 in this embodiment, the tapering can extend all the way to the outer surface of the hurler cord 34. The power cord end 37 defines the plug capture orifice 34 removably receiving the plug 10 therein so that, responding to pressing the plug 10 into the plug capture orifice 34, the plug 10 becomes fixed within the plug capture orifice 34 with the outer anti-snagging surface of the power cord end 37 tapering approximately to an outer surface of the power cord 12. The plug capture orifice 34 can be open to a side for inserting the plug 10 or a removable cover (illustrated with dashed lines in FIG. 3) can be pulled away for installation/removal of the plug 10. When removal of the plug hurler 20 is desired, the plug 10 separates from and exits the plug capture orifice 34 in response to a given force exerted by a user.

In an alternative exemplary embodiment, the plug-to-hurler connector 30 is fixed to the power cord 12, as shown in FIGS. 4 and 5. In this configuration, the plug hurler 20 comprises the throwing weight 22 and the hurler cord 24. A first hurler end 26 of the hurler cord 24 is connected to the throwing weight 22. The second hurler end 28 opposite the first hurler end 26 is to be connected to the power cord 12. In this exemplary embodiment, the plug-to-hurler connector 30' is permanently attached to the power cord 12. A connector body 32' is fixed at a distance from the plug 10 near or adjacent the second hurler end 28. The connector body 32' defines a plug capture orifice 34' shaped to removably receive the plug 10 therein. The plug 10 comprises electrical mains connectors 11 on one end and a plug end 13' either opposite the mains connectors 11 (illustrated) or at an angle to the mains connectors 11 (not illustrated). The plug end 13' in this embodiment has an outer anti-snagging surface tapering from the plug 10 inwards towards and up to the first power cord end 14. In a particular embodiment, the outer surface of the power cord 12 transitions seamlessly and smoothly to the plug end 13' to form an outer surface that is substantially smooth. The connector body 32' is connected to the power cord 12 at a point 15' at a distance from the plug and comprises a body portion 36' having a distal end 35' defining a plug orifice 37'. The plug 10 is plugged into the plug orifice 37' (as shown in FIG. 6) to form a loop of the power cord 12 that can be removably connected to the second hurler end 28. In the exemplary embodiment, the second hurler end 28 is a loop that can be threaded over the plug 10 and, when the plug 10 is removably connected to the plug orifice 37', the plug hurler 20 is connected to the power cord 12 for installation on a vertical structure. Snagging is prevented by the taper of the loop at the second hurler end 28 and the loop of the power cord 12. In this connected orientation, the outer anti-snagging plug end 13' forms a first surface that contacts the vertical structure 3 when the plug hurler 20 is used to pull the power cord 12 over the vertical structure 3. The connector body 32' has a smooth outer surface 38' that transitions smoothly with the end of the plug end 13' to minimize snagging. When connected, a power cord end 39' of the connector body 32' is opposite the distal end 35' of the body portion 36' and has another outer anti-snagging surface, for example, tapering smoothly from the outer surface 38' of the body portion 36' inwards towards and to the power cord 12 adjacent the point 15'. Together, the outer anti-snagging surface of the power cord end 39', the outer surface 38' of the body portion 36', and the outer anti-snagging surface of the plug end 13' form a bi-directional anti-snagging body.

Figure 7:
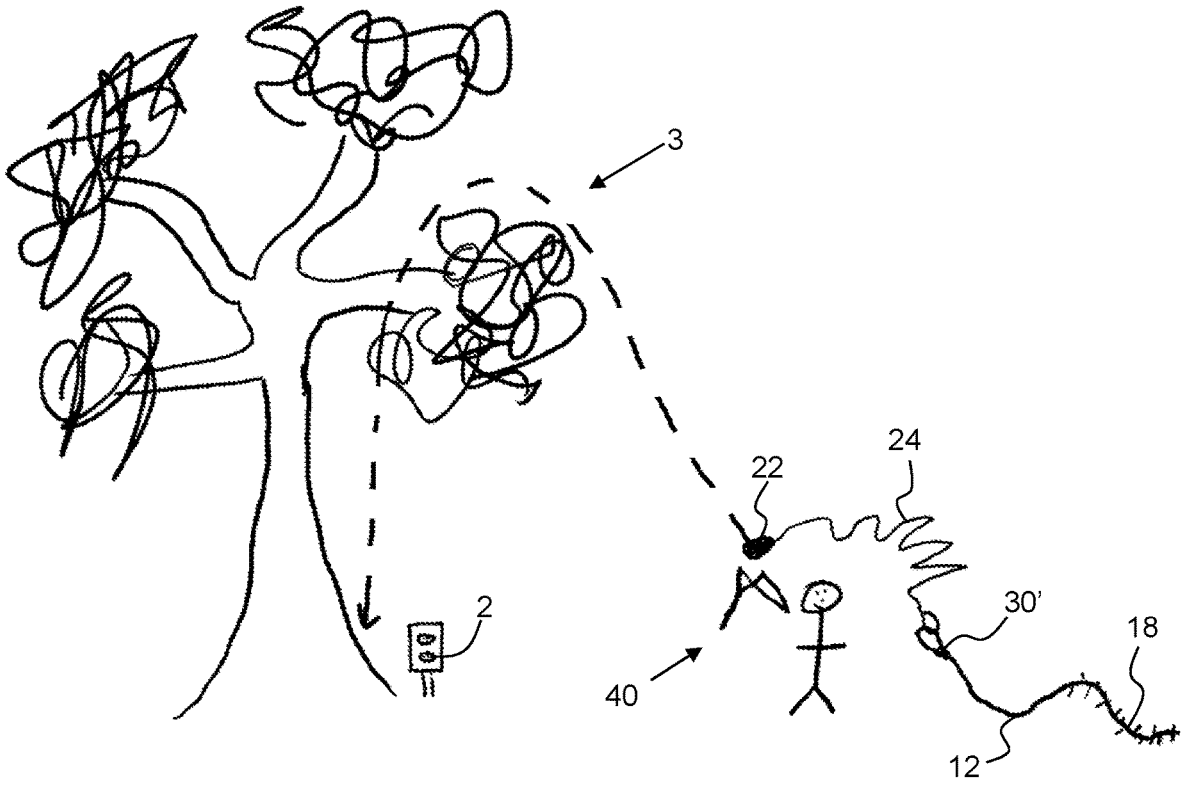
FIG. 7 is a diagrammatic representation of an exemplary embodiment of a light hanger system and a method for hanging lights over a vertical structure with a slingshot.

The throwing weight 22 is illustrated in FIGS. 3 and 6 in the form of a beanbag that can be thrown by the hand of a user. An alternative configuration of the throwing weight 22 takes a form that can be inserted into the pocket of a slingshot and then fired from the slingshot over the vertical structure 3 trailing the hurler cord 24. Such a configuration is illustrated in FIG. 7.

In operation, the user connects the plug hurler 20 to the power cord 12 (e.g., FIGS. 3 and 6). The user then throws/launches the throwing weight 22 over the vertical structure 3 and allows the throwing weight 22 to pass or loop over the vertical structure 3 with the throwing weight 22 hanging from one side of the vertical structure 3 and at least a portion of the hurler cord 24 including the second hurler end 28 hanging from the other side. The mass of the throwing weight 22 is sufficient to pull the hurler cord 24 up and over the vertical structure 3 at least until the user can grasp the throwing weight 22 or until the throwing weight 22 rests on ground. Before or after passing the weight 22 over the vertical structure 3, the user confirms that the plug-to-hurler connector 30, 30' is securely connected to the hurler cord 24 adjacent the second hurler end 28. The user pulls the hurler cord 24 further over the vertical structure 3 and raises the plug 10 up and over the vertical structure 3 and continues pulling the hurler cord 24 until a length of the power cord 12 and/or the cord of lights 18 hangs from the second side of the vertical structure 3 and the plug 10 is back within reach of the user so that the plug 10 can be inserted into the electrical mains 2. The power cord 12 is pulled so that a desired length of the cord of lights 18 hangs from the first side of the vertical structure 3 above ground. When the cord of lights 18 is electrically connected to the electrical mains 2 to receive power, one or more of the lights are illuminated.

In the configurations of the plug-to-hurler connector 30, 30', a first power cord end 14 of the multiple-light cord 1 is attached to the second hurler end 28 by removably inserting the plug 10 of the multiple-light string 1 into the plug capture orifice 34, 34'. In the configuration of FIGS. 3 and 4, the plug 10 is removably inserted into the plug capture orifice 34 to temporarily attach the multiple-light string 1 to the plug-to-hurler connector 30. The throwing weight 22 of the plug hurler 20 is passed over the vertical structure 3 so that a portion of the hurler cord 24 loops over the vertical structure 3 with the throwing weight 22 hanging from a first side of the vertical structure 3 and with the second hurler end 28 on or hanging from a second side of the vertical structure 3. With the plug 10 removably inserted in the plug capture orifice 34, the user pulls the hurler cord 24 further over the vertical structure 3 so that the plug-to-hurler connector 30 passes over the vertical structure 3 from the first side to the second side and a length of the power cord 12 hangs from the second side. The anti-snagging outer surface of the tapered hurler cord end 39 first contacts the vertical structure. The smooth outer surface 38 of the connector body 32 and the tapered power cord end 37 follow. In the configuration of FIGS. 5 and 6, the plug 10 is passed through the loop of the second hurler end 28 and then removably inserted into the plug capture orifice 34' to temporarily attach the multiple-light string 1 to the power cord 12. The throwing weight 22 of the plug hurler 20 is passed over the vertical structure 3 so that a portion of the hurler cord 24 loops over the vertical structure 3 with the throwing weight 22 hanging from a first side of the vertical structure 3 and with the second hurler end 28 on or hanging from a second side of the vertical structure 3. With the plug 10 removably inserted in the plug capture orifice 34', the user pulls the hurler cord 24 further over the vertical structure 3 so that the plug-to-hurler connector 30' passes over the vertical structure 3 from the first side to the second side and a length of the power cord 12 hangs from the second side. The loop of the power cord 12 first contacts the vertical structure on its way over the vertical structure. The anti-snagging outer surface of the plug end 13' first contacts the vertical structure. The smooth outer surface 36' of the connector body 32' and the tapered power cord end 39' follow.

In some instances, the user may desire to relieve tension within the power cord 12 because pulling on the power cord 12 in any manner when installing the multiple-light string 1 on the vertical structure 3 could cause damage that might interrupt delivery of electricity along the power cord 12 if the tension is applied directly to the electrical wires of the power cord 12. Therefore, a tension-relieving device can be embedded within the structure of the power cord 12. In an exemplary embodiment, the tension-relieving device is a fiber or wire or string that is embedded and/or over-molded inside the power cord 12. The tension-relieving device runs the length of the multiple-light string 1 and acts as a tension member. The length may end at an intermediate point to either stop or to have a different (e.g., lessened/increased) tension but, in either condition, the tensile strength of the tension-relieving device is greater than any of the electrical wires of the power cord 12 or of the lights of the cord 18 so that the tension-relieving device absorbs all tension placed on the multiple-light string 1. To add more lights to the distal end of the light cord 19, the distal end of the light cord 19 can terminate with a female Edison as is present in prior art holiday light strings. In an exemplary embodiment, the extension that is connected to this female Edison socket comprises only the cord of lights 18 so that lights viewed as extending from the multiple-light string 1 are viewed as a single, uninterrupted row of lights.

Herein, the words "cord" and "string" are used with respect to the light hanger. These terms when used in the plural are not limited to a plurality of cords or strings, cords/strings can be a single cord as well and, therefore, cords and cord are used interchangably. Cords and strings also are not limited to a particular type of material. The material can be made of natural fibers, man-made or synthetic fibers, plastics, and/or metals, to name a few. Cords also are not limited to a particular structure. The material can be made of twisted strands, twisted strands with a central core, or single strands of wires, to name a few. The embodiments described herein, however, are not limited to structures mentioned, even though the example of a standard power extension cord is referred to or is used herein.

It is noted that various individual features of the inventive processes and systems may be described only in one exemplary embodiment herein. The particular choice for description herein with regard to a single exemplary embodiment is not to be taken as a limitation that the particular feature is only applicable to the embodiment in which it is described. All features described herein are equally applicable to, additive, or interchangeable with any or all of the other exemplary embodiments described herein and in any combination or grouping or arrangement. In particular, use of a single reference numeral herein to illustrate, define, or describe a particular feature does not mean that the feature cannot be associated or equated to another feature in another drawing figure or description. Further, where two or more reference numerals are used in the figures or in the drawings, this should not be construed as being limited to only those embodiments or features, they are equally applicable to similar features or not a reference numeral is used or another reference numeral is omitted.

The foregoing description and accompanying drawings illustrate the principles, exemplary embodiments, and modes of operation of the systems, apparatuses, and methods. However, the systems, apparatuses, and methods should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the systems, apparatuses, and methods as defined by the following claims.

What is claimed is:

1. A system for hanging lights, comprising:

a multiple-light string comprising:

a plug for an electrical mains;

an electrical power cord having:

a first power cord end electrically connected to the plug;

a length of between approximately 5 and 20 meters; and a second power cord end opposite the first power cord end; and a cord of lights electrically connected to the second power cord end to receive power and illuminate at least one of the lights when the plug is connected to the electrical mains, the lights strung successively along a length of between approximately 5 and 20 meters;

a plug hurler comprising:
a throwing weight; and
a hurler cord having:
a first hurler end connected to the throwing weight; and
a second hurler end opposite the first hurler end and configured to removably connect to the plug.

2. The system according to claim 1, further comprising a plug-to-hurler connector:
comprising a connector body connected adjacent the second hurler end; and
defining a plug capture orifice shaped to removably receive the plug therein.

3. The system according to claim 1, wherein the connector body is one of:
removably connected to the second hurler end; and
fixedly connected adjacent the second hurler end.

4. The system according to claim 1, wherein the connector body is a clamshell having opposing body parts removably connected to one another and defining the plug capture orifice therebetween such that, responsive to closing the clamshell, the plug is fixed within the plug capture orifice, and, responsive to opening the clamshell, the plug is removable from the plug capture orifice.

5. The system according to claim 1, wherein the connector body is connected at the second hurler end and comprises:
a central body portion defining an outer surface;
a power cord end having an outer anti-snagging surface tapering from the outer surface of the central body portion inwards; and
a hurler cord end opposite the power cord end and having an outer anti-snagging surface tapering from the outer surface of the central body portion inwards towards and to the second hurler end.

6. The system according to claim 5, wherein the connector body is removably connected to the second hurler end.

7. The system according to claim 5, wherein the connector body is fixed at the second hurler end.

8. The system according to claim 5, wherein at least the power cord end defines the plug capture orifice removably receiving the plug therein such that, responsive to inserting the plug into the plug capture orifice, the plug is removably fixed within the plug capture orifice, and, responsive to a given removal force, the plug separates from and exits the plug capture orifice.

9. The system according to claim 5, wherein:
the power cord has an outer surface; and
the outer anti-snagging surface of the power cord end tapers to the outer surface of the power cord when the plug is disposed within the plug capture orifice.

10. The system according to claim 1, wherein:
the plug has electrical mains connectors and a plug end having an outer anti-snagging surface tapering inwards towards and to the first power cord end; and
the connector body is connected to the power cord at a point at a distance from the plug and comprises a body portion comprising:
a distal end defining a plug orifice;
an outer surface; and
a power cord end opposite the distal end and having an outer anti-snagging surface tapering from the outer surface of the body portion inwards towards and to the power cord adjacent the point.

11. The system according to claim 10, wherein the outer anti-snagging surface of the power cord end, the outer surface of the body portion, and the outer anti-snagging surface of the plug end together form a bi-directional anti-snagging body.

12. The system according to claim 10, wherein the plug end one of opposite and at an angle to the mains connectors.

13. The system according to claim 10, wherein the electrical mains connectors of the plug are configured to removably fix within the plug orifice of the distal end and form a loop with a portion of the power cord between the plug and the connector body.

14. The system according to claim 13, wherein the second hurler end is removably connected to the loop.

15. The system according to claim 1, further comprising a slingshot, the throwing weight shaped to be thrown/shot from the slingshot over a distance.

16. The system according to claim 1, wherein the electrical mains is 1.10 v, 120 v, and USB.

17. The system according to claim 1, wherein the electrical power cord is one of 8 gauge, 10 gauge, 12 gauge, 14 gauge, 16 gauge, 18 gauge, and 20 gauge.

18. The system according to claim 1, wherein the cord of lights is a string of at least one of:
successive LED lights;
successive incandescent lights;
successive fluorescent lights;
successive bioluminescent;
successive chemiluminescent lights;
successive phosphorescent lights; and
successive radioluminescent lights.

19. The system according to claim 1, wherein the string of lights are Christmas lights.

20. A system for hanging lights, comprising:
a multiple-light string comprising:
a plug for an electrical mains;
an electrical power cord having:
a first power cord end electrically connected to the plug;
an outer surface;
a length of between approximately 5 and 20 meters; and
a second power cord end opposite the first power cord end;
a cord of lights electrically connected to the second power cord end to receive power and illuminate at least one of the lights when the plug is connected to the electrical mains, the lights strung successively along a length of between approximately 5 and 20 meters;
a plug hurler comprising:
a throwing weight; and
a hurler cord having:
a first hurler end connected to the throwing weight; and
a second hurler end opposite the first hurler end; and
a plug-to-hurler connector comprising a clamshell connector body:
removably connected adjacent the second hurler end; and
having opposing body parts removably connected to one another, the body parts:
defining a plug capture orifice therebetween and shaped to removably receive the plug therein such that, responsive to closing the clamshell, the plug is fixed within the plug capture orifice, and, responsive to opening the clamshell, the plug is removable from the plug capture orifice; and
comprising:

a central body portion defining an outer surface;

a power cord end having an outer anti-snagging surface tapering from the outer surface of the central body portion inwards to the outer surface of the power cord; and a hurler cord end opposite the power cord end and having an outer anti-snagging surface tapering from the outer surface of the central body portion inwards towards and to the second hurler end.

* * * * *